United States Patent [19]

Gianese

[11] Patent Number: 4,691,848

[45] Date of Patent: Sep. 8, 1987

[54] DEVICE FOR FEEDING CIGARETTES OR THE LIKE ROD-LIKE ARTICLES

[75] Inventor: Goffredo Gianese, Bologna, Italy

[73] Assignee: Sasib S.p.A., Bologna, Italy

[21] Appl. No.: 677,352

[22] Filed: Dec. 3, 1984

[30] Foreign Application Priority Data

Dec. 9, 1983 [IT] Italy ..... 12691 A/83

[51] Int. Cl.[4] ..... G01F 11/00

[52] U.S. Cl. ..... 222/269; 222/280; 131/282

[58] Field of Search ..... 222/415, 269, 280, 281, 222/271, 272; 221/253, 307, 303; 53/236, 260, 245; 131/282, 283; 198/425

[56] References Cited

U.S. PATENT DOCUMENTS

| | | | |
|---|---|---|---|
| 2,592,642 | 4/1952 | Bardet | 53/245 X |
| 2,826,883 | 3/1958 | Pollmann | 53/236 |
| 2,924,356 | 2/1960 | Pollmann | 221/175 |
| 2,933,872 | 4/1960 | Pollmann | 53/236 X |

*Primary Examiner*—Joseph J. Rolla

*Assistant Examiner*—David H. Bollinger

*Attorney, Agent, or Firm*—Spencer & Frank

[57] ABSTRACT

The device for feeding cigarettes (S), or the like, is particularly adapted for use in a machine for filling the trays (1) intended for supplying a cigarette-packing machine. The device comprises at least one upstanding or inclined cigarette-guiding channel (3), which at both sides is delimited by at least one small belt (5, 6), and along which the cigarettes coming, for example, from an overlying cigarette mass contained in a cigarette-feeding hopper (2) descend in a horizontal disposition, and as a mass flow. The sides of the lower mouth of the cigarette-guiding channel (3) are bound by two endless conveyor members consisting of rollers, or preferably of small belts (31, 32), set in a facing and reciprocally shiftable relation, and which are drawn apart by the thrust of the cigarettes and are moved into a position for opening the lower mouth of the cigarette-guiding channel (3), these endless conveyor members (31, 32) being again moved by the action of suitable returning forces into a channel-mouth closing position, as soon as the said thrust ceases or decreases.

18 Claims, 6 Drawing Figures

DEVICE FOR FEEDING CIGARETTES OR THE LIKE ROD-LIKE ARTICLES

BACKGROUND AND SUMMARY OF THE INVENTION

The invention has for its object a device for feeding cigarettes or any other similar rod-like articles of the tobacco industry, such as filter rods and the like, which device comprises at least one substantially upstanding or inclined cigarette-guiding channel along which the cigarettes coming, for example, from an overlying cigarette mass contained in a cigarette-feeding hopper, descend in a horizontal disposition and as a mass flow, and come out of the lower mouth of the cigarette-guiding channel, means being provided for interrupting at will the said cigarette outflow. Feeding devices of this kind are used, for example, in a machine for filling the cigarette trays intended for supplying a cigarette-packing machine.

In the known cigarette-feeding devices of this kind, the means provided at the lower mouth of the cigarette-guiding channel and designed for interrupting the cigarette outflow from the said channel, consist of suction portions that are activated at will so as to stop the cigarettes in the said channel mouth. Besides these pneumatic means, also mechanical cigarette-intercepting means are known, which comprise at least one small roller that upon control is moved from a rest position, in which it allows the cigarettes to freely pass through the mouth of the cigarette-guiding channel, into a mouth-closing position beneath the said mouth, in which it hinders the cigarettes from passing through, and flowing out of, the mouth of the cigarette-guiding channel. While affording the advantage of not requiring movable parts into contact with the cigarettes, the above-described pneumatic means for stopping the cigarette outflow from the lower mouth of the cigarette-guiding channel do not however assure a sufficiently safe operation, since the suction ports may be blocked by any tobacco particles unavoidably dropping from the cigarette ends. The above-described mechanical cigarette-intercepting means have instead the disadvantage of a relatively complicated construction.

The object of the invention is to eliminate the aforementioned disadvantages in the heretofore known constructions, and to provide a feeding device of the kind as disclosed in the preamble, in which the cigarette outflow from the lower mouth of the cigarette-guiding channel can be most safely interrupted and resumed by the use of means of a simple construction, affording also a number of additional advantages, particularly the advantage of compensating automatically any small transient differences between the cigarette rate delivered from the mouth of the cigarette-guiding channel and the cigarette rate being taken in downstream of the feeding device.

This object is attained by the invention with a feeding device of the kind as described in the preamble, which is substantially characterized by the feature that the lower mouth of the cigarette-guiding channel is bound at the sides thereof by two endless conveyor members set in a facing relation and shiftable from a mouth-closing position in which they are drawn near to each other so as to close the mouth of the cigarette-guiding channel and prevent the cigarettes from flowing out therefrom, into a mouth-opening position in which they are drawn away from each other so to open the mouth of the cigarette-guiding channel and allow the cigarettes to flow out therefrom.

Preferably, according to a further characteristic feature of the invention, the two reciprocally shiftable endless conveyor members provided in an oppositely arranged relation at the lower mouth of the cigarette-guiding channel, are urged the one toward the other by return forces, whereby they tend to be moved into mouth-closing position, the said endless conveyor members being drawn away from each other and moved into mouth-opening position by the thrust as exerted thereon by the cigarettes that are urged to descend along the cigarette-guiding channel and/or to flow out of the mouth thereof by a driving force being adjunctive to the force of gravity and to the pressure as applied by the weight of an overlying cigarette mass, which driving force is upon control reducible, annullable, or reversible. In this instance, to interrupt the cigarette outflow from the mouth of the cigarette-guiding channel, it will be sufficient to reduce, annull, or reverse the adjunctive driving force urging for the descent of the cigarettes along the said channel, thus decreasing or annulling the thrust exerted by the cigarettes on the conveyor members provided at the mouth of the cigarette-guiding channel, whereby the returning forces acting upon these endless conveyor members are allowed to shift them into mouth-closing position.

The driving force urging the cigarettes to flow out of the bottom of the cigarette-guiding channel, which is joined to the force of gravity and/or the weight pressure of an overlying cigarette mass, can be obtained by operating the endless conveyor members provided at the mouth of the cigarette-guiding channel so as to cause them to run in the direction for delivering the cigarettes from the said channel, and/or by delimiting the cigarette-guiding channel at the sides thereof and over at least a portion of its height, upsteam of the said endless conveyor members provided at the said channel mouth, by means of small endless belts of chain tracks, or the like, arranged in an opposite relation and operated so as to drive down the cigarettes toward the mouth of the cigarette-guiding channel. In this instance, to interrupt the cigarette outflow from the lower mouth of the cigarette-guiding channel, it will be sufficient to stop or reverse the movement of the endless conveyor members provided at the mouth of said channel, and/or of the endless belts or chain tracks delimiting the sides of the cigarette-guiding channel.

The reciprocally shiftable endless conveyor members provided on opposite sides of the lower mouth of the cigarette-guiding channel may consist of rollers or of endless small belts or chain tracks. These endless chain tracks or belts are led about respective small pulleys, preferably so as to be set with two downwardly converging, oppositely arranged stretches, which are designed for receiving the thrust of the overlying cigarette mass, in order to move the said chain tracks or belts into mouth-opening position.

BRIEF DESCRIPTION OF THE DRAWINGS

These and other characteristic features of the invention, and the advantages arising therefrom will clearly appear in the following specification of one preferred embodiment thereof, which is shown by way of a non-limiting example in the accompanying drawings, in which.

DESCRIPTION OF THE PREFERRED EMBODIMENT

Figure 1:
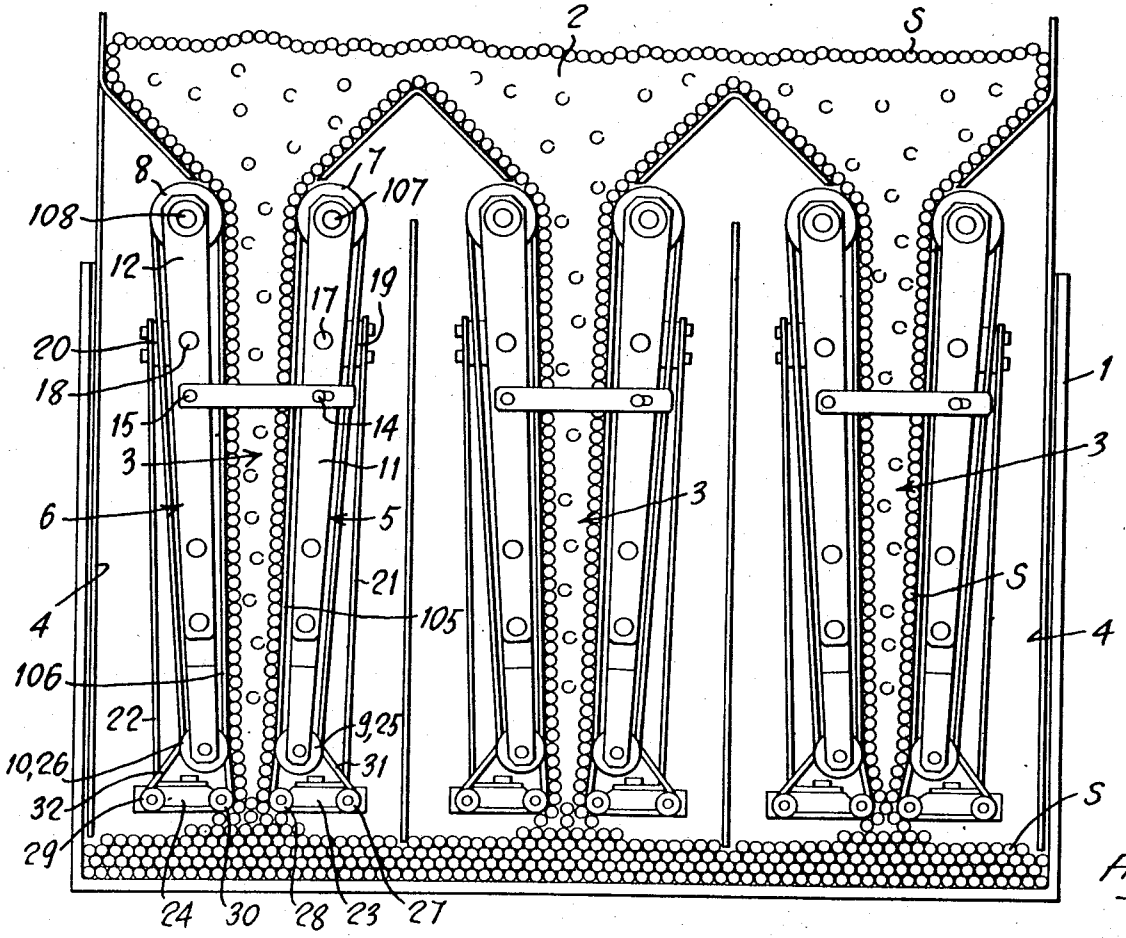
FIG. 1 is a front elevational view showing a cigarette-feeding device according to the invention, which is designed for filling cigarette trays.
Figure 2:
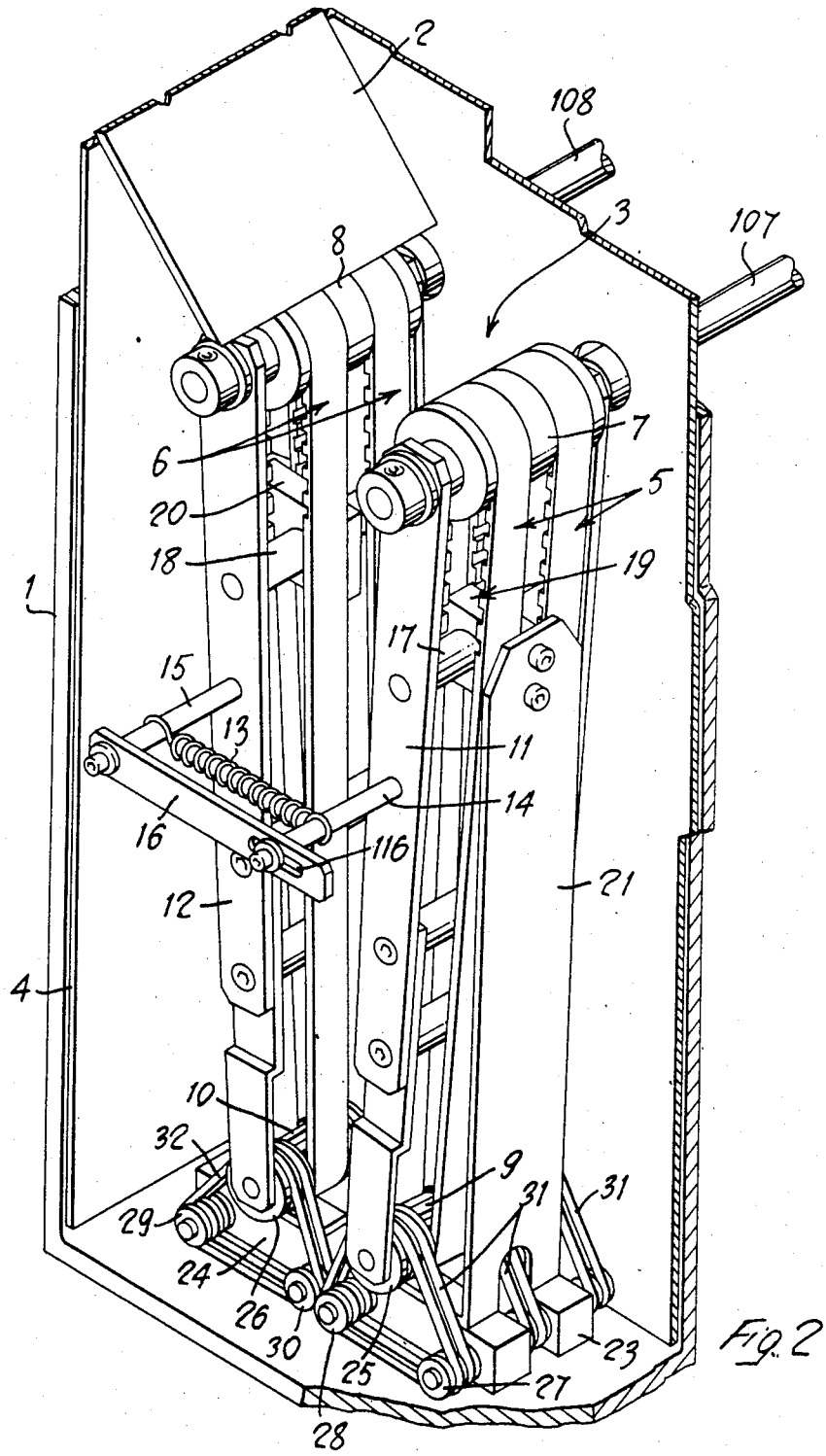
FIG. 2 is a perspective view showing one of the vertically extending cigarette-guiding channels in the cigarette-feeding device according to FIG. 1.
Figure 3:
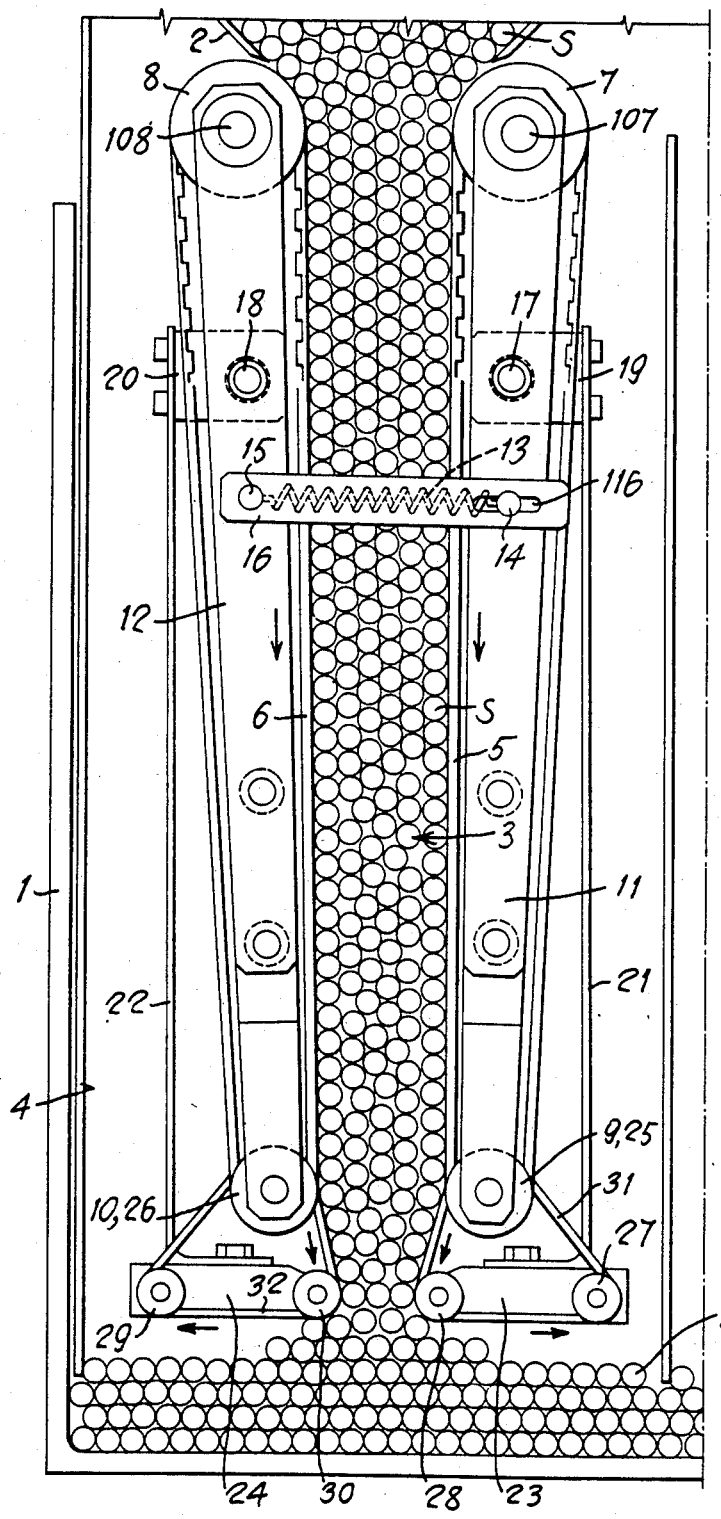
FIGS. 3 and 4 are elevational views, in an enlarged scale, showing one of the vertically extending cigarette-guiding channels in the cigarette-feeding device according to FIG. 1, with its bottom mouth open (FIG. 3), respectively closed (FIG. 4).
Figure 4:
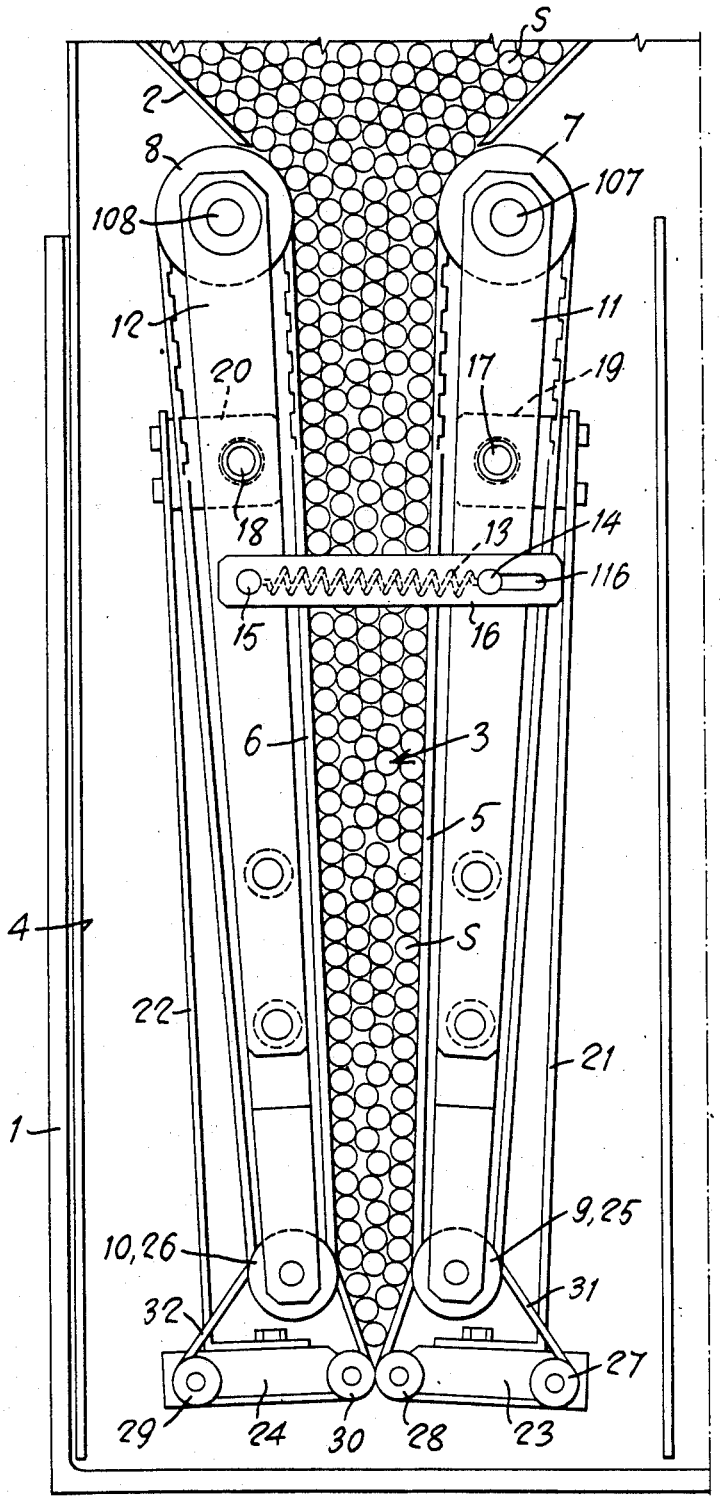

The cigarette-feeding device as shown in the drawings forms part of a machine designed for filling with cigarettes S the trays 1 by which the cigarettes S are, for example, conveyed from a cigarette-making machine to a cigarette-packing machine. These trays 1 consist, as it is well known, of prismatic containers, which are open at their top side and at their front end. The cigarettes S are contained in a cigarette-feeding hopper 2 with three side-by-side upright channels or ducts 3 extending downwardly from the bottom thereof, and terminating with their lower ends at a same level. Once the lower mouths of the cigarette-guiding channels have been closed, the tray 1 which is to be filled will be threadedly engaged from below in lateral, matching lower guides 4 of hopper 2, to such an extent as to have the bottom thereof moved close to the lower mouths of the said cigarette-guiding channels 3, as shown in FIG. 4. The lower mouths of the upright cigarette-guiding channels 3 are then opened, so that the cigarettes S coming from the overlying cigarette-feeding hopper 2 into the channels 3 as a mass flow, are allowed to flow out of these channels, while the tray 1 will be gradually lowered as it is being filled, as shown in FIGS. 1 and 3. Means (not shown) are provided for controlling the lowering of the cigarette tray 1 at such a speed that the cigarette rate being delivered from the cigarette-guiding channels 3 will be taken up by the tray, and that the free surface of the cigarettes in the tray will be always kept at the required small distance from the mouths of the cigarette-guiding channels 3. Once the tray 1 has been filled, and must be replaced, the cigarette outflow from the lower mouths of the upstanding channels 3 will be stopped until the positioning of the next empty tray has been accomplished.

Both sides of each upstanding cigarette-guiding channel 3 are formed by the facingly arranged stretches of two pairs of small flat cog belts 5—5 and 6—6. Each pair of belts 5—5 and 6—6 is led about an upper, toothed small driving pulley 7, 8 which is made integral of a respective, horizontally arranged driving shaft 107, 108, as well as about a toothed, lower small guide pulley 9, 10 which is carried by a frame 11, 12 swingably mounted onto the driving shafts 107, 108 for the matching upper driving pulley 7, 8. A pulling spring 13 stretched between two horizontal pins 14 and 15 being integral with either one of the swingable frames 11, 12, urges these frames toward each other, thus causing the facingly arranged stretches of the two belt pairs 5—5 and 6—6 to converge downwardly toward one another. Secured to pin 15 is a platelet 16 having a slot 116, in which the end of the other pin 14 is engaged, whereby the reciprocal angular movement of both belt-supporting swingable frames 11, 12 near to, and away from each other, and thus the degree of convergency of the facingly arranged stretches of both belt pairs 5—5 and 6—6, will be restricted.

About a horizontal pivot 17, 18 provided on each belt-supporting swingable frame 11 and 12 at a distance below the upper driving pulleys 7, 8, a block 19, 20 is rotatably mounted, so as to be inserted between the external stretches of the respective pair of belts 5—5 and 6—6, and carries a downwardly extending arm 21, 22. Secured to the lower end of these swingable arms 21, 22 is a shoe 23, 24. Around the outer pulleys 25, 26 that are co-axial to, and are made integral of the inner pulleys 9, 10 for guiding the two pairs of cog belts 5—5, 6—6, and around guide pulleys 27, 28 and 29, 30 that are mounted substantially at a same level onto either one of shoes 23, 24, at both sides of the lower mouth of each upstanding cigarette-guiding channel 3, there are passed three pairs of small round belts 31 and 32 that through their oppositely arranged convergent stretches delimit laterally the mouth of the corresponding cigarette-guiding channel 3. The convergency of these oppositely arranged stretches of belts 31 and 32 is greater than that of the overlying facingly arranged stretches of the belt pairs 5—5, 6—6.

Both of the assemblies respectively comprising a block 19, 20, a swingable arm 21, 22, and the appertaining shoe 23, 24 fitted with the guide pulleys 27, 28, and 29, 30, are set in an out-of-balance condition, namely their barycenters are so located relatively to the respective pivot 17, 18 about which they swing, that the two shoes tend to be drawn near to, and come, for example, into contact with each other by their oppositely set pulleys 28, 30, whereby they close the lower mouth of the respective cigarette-guiding channel 3, as shown in FIG. 4. The two shoes 23, 24 can be so urged so to be drawn near to each other, and as to be moved into a position for closing the respective cigarette-guiding channel 3, also owing to the tension of the relative belts 31, 32.

During the step of filling a tray 1, the cigarettes contained in hopper 2 descend into the channels 3 as a mass flow, that is to say, in form of a plurality of layers, by gravity, and under the thrust of the overlying cigarette mass, as well as under the action of the driving force being exerted by the facingly arranged stretches of the flat belt pairs 5—5, 6—6 and by the opposed stretches of the round belts 31, 32 provided at the mouth of channel 3. For this purpose, the driving shafts 107, 108 are driven in opposite directions, such as by a reversible motor (not shown), whereby the facingly arranged stretches of the two belt pairs 5—5, 6—6 are caused to run downward; these belt pairs will drive the underlying guide pulleys 9, 10, which in turn drive the respective belts 31, 32 so as to cause the opposed convergent stretches of said belts 31, 32 to run in the same direction, that is, downwardly. Both the slightly converging upper belts 5, 6 and the following more converging lower belts 31, 32 also apply a small lateral pressure on the cigarette mass, due to the bias of spring 13 and the above-described out-of-balance condition of the shoes 23, 24. The descending cigarette mass being carried down along the cigarette-guiding channels 3, in its turn exerts a thrust on the opposed stretches of belts 31, 32 bounding the sides of said channel mouth, so that the shoes 23, 24 will be moved apart and away from each other, and the shoe-supporting arms 21, 22 will be caused to swing outwardly about the respective pivots 17, 18, so as to open the lower mouth of the cigarette-guiding channel, as shown in FIG. 3. The convergent inner branches of belts 31, 32 help the issuing of the cigarettes S from the mouth of channel 3, while the horizontal lower branches of said belts running outward in opposite directions, promote the distribution of the cigarettes S within the space between the shoes 23, 24 and the bottom of tray 1 or the free surface of the cigarettes already held in tray 1, as it appears evident from the arrows in FIG. 3.

To close the lower mouth of the cigarette-guiding channels 3, once the filling of a tray has been completed, in order to replace the full tray with an empty tray, the direction of rotation of both driving shafts 107, 108 will be reversed for a period of time corresponding to the required mouth closure time, and therefore also the direction of movement of the two belt pairs 5—5, 6—6 and of the lower belts 31, 32 will be reversed, so that the facingly arranged branches of the two belt pairs 5—5, 6—6 and the converging oppositely arranged stretches of the lower belts 31, 32 are caused to run in the upward direction. Thus, both the force driving down the cigarettes along channel 3 and the downward cigarette pressure inside the cigarette-guiding channel 3, which is due to the force of gravity and the weight of the cigarette mass in the overlying hopper 2, will be eliminated, since the cigarettes are being entrained upwards, and are compelled to ascend the channels 3. In this way, it is annulled the thrust opening out the opposed converging sections of the lower belts 31, 32, as exerted thereon by the cigarettes, whereby the out-of-balance shoes 23, 24 will be automatically drawn near to each other and caused to close the mouth of channel 3, as previously described, and as shown in FIG. 4.

In order to bring about the closure of the lower mouth of channel 3, in place of reversing the movement of belts 5 and 6, 31 and 32, it may be sufficient to temporaneously stop the running of these belts, thus annulling only the downward driving force as exerted thereby on the cigarettes contained in the cigarette-guiding channel 3, when the weight of the cigarettes and the pressure of the overlying mass of cigarettes contained in hopper 2 are not by themselves sufficient for moving apart the shoes 23, 24 and for driving them into the position for opening the mouth of channel 3.

During the outflow of the cigarettes S from the lower mouth of the cigarette-guiding channel 3, the possibility of having both shoes 23, 24 with the respective opposed lower belts 31, 32 moved away or apart from each other, against the returning force as determined by gravity, and/or, more particularly, by the two upper belt pairs 5—5, 6—6 with the respective belt-supporting frames 11, 12, against the returning force as exerted by spring 13, allows to correct for any small and transient differences between the rate of the cigarettes flowing out of the mouth of the cigarette-guiding channel 3 and the rate of the cigarettes being accomodated by a gradually lowered tray 1. Thus, for example, when the lowering rate of tray 1 is slower than the rate as required for taking in all of the cigarettes issuing from the mouths of the cigarette-guiding channels 3, the resistance as encountered by the cigarettes to flow out out the mouths of channels 3 and to settle in within the space underneath the shoes 23, 24 increases, so that also the lateral pressure in the mass of cigarettes contained in channels 3, will increase. This increase in the lateral pressure promotes the elastic opening out principally of both belt-supporting frames 11, 12, and then of the respective facingly arranged belt pairs 5—5, 6—6, whereby the width, and therefore the capacity of the respective cigarette-guiding channel 3, increases, and thus the transient and/or small excess in the cigarette flow along said channel 3 toward the mouth thereof will be accomodated.

Figure 6:
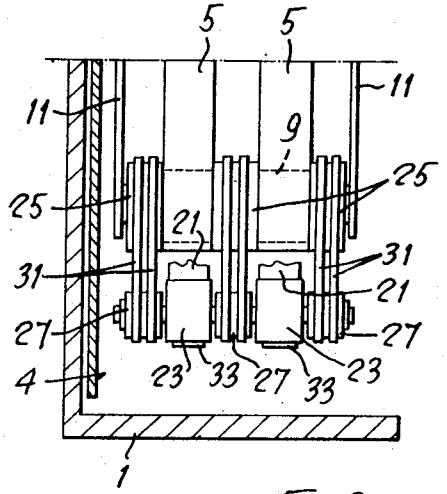
FIGS. 5 and 6 are side elevational views showing some details of the cigarette-guiding channel according to FIGS. 1 to 4.
Figure 5:
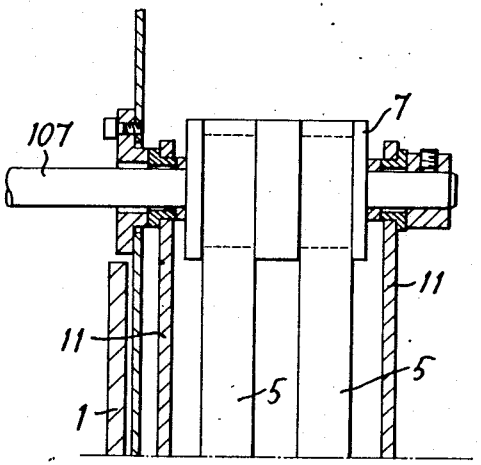

According to a further characteristic feature of the invention, extensometers 33 being, for example, provided at the bottom of shoes 23,24, as diagrammatically shown in FIG. 6, may be used for attaining a still greater accuracy. It is then possible to vary the speed of the belt pairs 5—5, 6—6 and of the lower belts 31, 32 as a function of the pressure values being measured by these extensometers 33, for example by operating the two shafts 107, 108 driving the belts 5 and 6, 31 and 32 that are associated to each upright channel, by means of one respective motor of the variable speed type.

I claim:

1. A device for feeding rod-like articles to a receptacle, comprising:

a downwardly extending article-guiding channel, having opposite sides and having a lower end with a mouth that has opposite sides, through which horizontally disposed articles descend as a mass flow, and are delivered from the mouth to the receptacle; and interruption means fior interrupting at will the descent of the articles through the channel, said interruption means including two endless conveyor members, mounting means for movably mounting the conveyor members in an oppositely arranged relation so that the conveyor members delimit the sides of the mouth of the channel and so that both conveyor members are shiftable, the conveyor members being shiftable from a mouth-closing position in which they are drawn near to each other so as to close the mouth of the channel and hinder the articles from flowing out therefrom, into a mouth-opening position in which they are drawn away from each other so as to open the mouth of the channel and allow the articles to flow out therefrom, urging means, cooperating with the mounting means, for urging the conveyor members toward one another, so that they tend to move into the mouth-closing position, and driving means for applying a driving force to the articles in the channel to thrust the articles toward the receptacle, the thrust of the articles tending to spread the conveyor members so that they move into their mouth-opening position, the driving force being additional to the force of gravity and to the pressure applied by any overlying articles in the channel and being selectively reducible, annullable, and reversible to decrease the thrust applied by the articles on the conveyor members so that the urging means is allowed to move them into the mouth-closing position, wherein the mounting means comprises two support members, each conveyor member being mounted on a respective support member, and wherein the urging means comprises means for swingably mounting the support members in an out-of-balance condition, such that they tend to move by gravity into a position corresponding to the mouth-closing position of the respective endless conveyor members.

2. The device according to claim 1, wherein the urging means further comprises a spring.

3. The device according to claim 1, wherein the driving means comprises means for running the endless conveyor members in the direction for delivering the articles from said channel.

4. The device according to claim 1, wherein the mounting means further comprises at least one first roller disposed at one side of the mouth of the channel to guide one of the conveyor members, and at least one second roller disposed at the other side of the mouth of the channel to guide the other of the conveyor members.

5. The device according to claim 1, wherein each conveyor member comprises at least one belt, one band, one chain track, or the like.

6. The device according to claim 1, wherein the rod-like articles are cigarettes.

7. A device for feeding rod-like articles to a receptacle, comprising:

first and second horizontal drive shafts mounted at spaced-apart positions;

a first upper pulley affixed to the first drive shaft;

a second upper pulley affixed to the second drive shaft;

a first elongated frame member having an upper end and a lower end, the first frame member being swingably mounted on the first drive shaft at its upper end;

a second elongated frame member having an upper end and a lower end, the second frame member being swingably mounted on the second drive shaft at its second end;

a first lower pulley rotatably mounted on the first frame member at its lower end;

a second lower pulley rotatably mounted on the second frame member at its lower end, the first and second lower pulleys being spaced apart;

a first belt that is guided by the first upper and lower pulleys;

a second belt that is guided by the second upper and lower pulleys;

hopper means above the drive shafts for depositing the rod-like articles between the first and second belts;

first and second elongated arms having upper and lower ends;

means for swingably mounting the upper end of the first arm to the first frame member at a position between the upper and lower ends of the first frame member, the lower end of the first arm being positioned lower than the end of the first frame member;

means for swingably mounting the upper end of the second arm to the second frame member at a position between the upper and lower ends of the second frame member, the lower end of the second arm being positioned lower than the end of the second frame member;

a further first pulley rotatably mounted on the first arm adjacent the lower end thereof;

a further second pulley rotatably mounted on the second arm adjacent the lower end thereof, the further first and second pulleys being spaced apart by a distance that is less than the spacing between the lower first and second pulleys;

an additional first pulley that is operatively connected to the lower first pulley;

an additional second pulley that is operatively connected to the lower second pulley;

a further first belt that is guided by the further first pulley and the additional first pulley; and a further second belt that is guided by the further second pulley and the additional second pulley.

8. The device according to claim 7, further comprising another first pulley that is rotatably mounted on the first arm adjacent the lower end thereon, the further first pulley and another first pulley being disposed along a substantially horizontal line, the further first belt additionally being guided by the another first pulley, and further comprising another second pulley that is rotatably mounted on the second arm adjacent the lower end thereof, the further second pulley and another second pulley being disposed along a substantially horizontal line, the further second belt additionally being guided by the another second pulley.

9. The device according to claim 8, wherein the portion of the further first belt that lies between the further and additional first pulleys is disposed below the lower end of the first arm, and wherein the portion of the further second belt that lies between the further and another second pulleys lies below the lower end of the second arm.

10. The device according to claim 7, wherein the means for swingably mounting the upper end of the first arm comprises means for mounting the first arm in an offset manner, so that gravity urges the lower end of the first arm toward the lower end of the second arm, and wherein the means for swingably mounting the upper end of the second arm comprises means for mounting the second arm in an offset manner, so that gravity urges the lower end of the second arm toward the lower end of the first arm.

11. The device according to claim 10, further comprising spring means for urging the first and second frame members toward one another.

12. The device according to claim 7, wherein the first and second frame members are identical and the first and second arms are identical.

13. A device for feeding rod-like articles to a receptacle, comprising:

a downwardly extending article-guiding channel, having opposite sides and having a lower end with a mouth that has opposite sides, through which horizontally disposed articles descend as a mass flow, and are delivered from the mouth to the receptacle;

interruption means for interrupting at will the descent of the articles through the channel, said interruption means including two endless conveyor members, mounting means for movably mounting the conveyor members in an oppositely arranged relation so that the conveyor members delimit the sides of the mouth of the channel and so that both conveyor members are shiftable, the conveyor members being shiftable from a mouth-closing position in which they are drawn near to each other so as to close the mouth of the channel and hinder the articles from flowing out therefrom, into a mouth-opening position in which they are drawn away from each other so as to open the mouth of the channel and allow the articles to flow out therefrom, urging means, cooperating with the mounting means, for urging the conveyor members toward one another, so that they tend to move into the mouth-closing position, and driving means for applying a driving force to the articles in the channel to thrust the articles toward the receptacle, the thrust of the articles tending to spread the conveyor members so that they move into their mouth-opening position, the driving force being additional to the force of gravity and to the pressure applied by any overlying articles in the channel and being selectively reducible, annullable, and reversible to decrease the thrust applied by the articles on the conveyor members so that the urging means is allowed to move them into the mouth-closing position;

two additional endless conveyor members; and means for movably mounting the additional conveyor members at either side of the channel, over at least a portion of its height, wherein the driving means comprises means for running the additional conveyor members so as to drive down the articles toward the mouth of the channel.

14. The device according to claim 13, wherein the means for mounting the additional conveyor members comprises two frames having upper and lower ends, each additional conveyor member being mounted on a respective frame, and means mounting the frames for swinging movement about their respective upper ends, wherein the urging means comprises spring means for biasing the frames the one toward the other, and further comprising stop means for maintaining at least a predetermined minimum separation between the frames.

15. The device according to claim 14, wherein the mounting means comprises two support members, each conveyor member being mounted on a respective support member, and means for swingably mounting each support member onto a respective frame.

16. A device for feeding rod-like articles to a receptacle, comprising:

a downwardly extending article-guiding channel, having opposite sides and having a lower end with a mouth that has opposite sides, through which horizontally disposed articles descend as a mass flow, and are delivered from the mouth to the receptacle; and interruption means for interrupting at will the descent of the articles through the channel, said interruption means including two endless conveyor members, mounting means for movably mounting the conveyor members in an oppositely arranged relation so that the conveyor members delimit the sides of the mouth of the channel and so that both conveyor members are shiftable, the conveyor members being shiftable from a mouth-closing position in which they are drawn near to each other so as to close the mouth of the channel and hinder the articles from flowing out therefrom, into a mouth-opening position in which they are drawn away from each other so as to open the mouth of the channel and allow the articles to flow out therefrom, urging means, cooperating with the mounting means, for urging the conveyor members toward one another, so that they tend to move into the mouth-closing position, and driving means for applying a driving force to the articles in the channel to thrust the articles toward the receptacle, the thrust of the articles tending to spread the conveyor members so that they move into their mouth-opening position, the driving force being additional to the force of gravity and to the pressure applied by any overlying articles in the channel and being selectively reducible, annullable, and reversible to decrease the thrust applied by the articles on the conveyor members so that the urging means is allowed to move them into the mouth-closing position, wherein the mounting means comprising a first set of pulleys disposed at one side of the mouth of the channel, one of the conveyor members being guided by the first set of pulleys, and a second set of pulleys disposed at the other side of the mouth of the channel, the other of the conveyor members being guided by the second set of pulleys, the pulleys of the first and second sets being positioned so that the respective conveyor members present two opposed, downwardly converging stretches.

17. The device according to claim 16, wherein the mounting means further comprises two swingably mounted support members having lower ends, and wherein each set of pulleys is mounted on a respective support member and includes at least three pulleys that are arranged at the vertices of a triangle, two of the pulleys of each set being lower pulleys that are located substantially at the same level and that guide a substantially horizontal stretch of the respective conveyor member so that it projects from the lower end of the respective support member.

18. The device according to claim 16, further comprising two additional endless conveyor members, and means, including two upper additional pulleys and two lower additional pulleys, for movably mounting the additional conveyor members at either side of the channel, each additional conveyor member being guided by a respective upper and lower additional pulley, and wherein one of the first set of pulleys is integral with one of the lower additional pulleys and one of the second set of pulleys is integral with the other lower additional pulley.

* * * * *